US006561840B2

(12) United States Patent
Bechaz et al.

(10) Patent No.: US 6,561,840 B2
(45) Date of Patent: May 13, 2003

(54) SELF-STRIPPING CONNECTING DEVICE FOR A SHEATHED ELECTRICAL CONDUCTOR

(75) Inventors: Bernard Bechaz, Caluire (FR); Laurent Guillermier, Miribel (FR)

(73) Assignee: Entrelec S.A., Lyons (FR)

( * ) Notice: Subject to any disclaimer, the term of this patent is extended or adjusted under 35 U.S.C. 154(b) by 0 days.

(21) Appl. No.: 09/875,911

(22) Filed: Jun. 8, 2001

(65) Prior Publication Data

US 2002/0031936 A1 Mar. 14, 2002

(30) Foreign Application Priority Data

Jun. 9, 2000 (FR) ..... 00 07460

(51) Int. Cl.[7] ..... H01R 13/58
(52) U.S. Cl. ..... 439/456; 439/401
(58) Field of Search ..... 439/456, 457, 439/458, 459, 417, 395–410

(56) References Cited

U.S. PATENT DOCUMENTS 5,297,975 A * 3/1994 Gerke et al. ..... 439/358
5,683,272 A * 11/1997 Abe ..... 439/747
5,997,337 A * 12/1999 Torii ..... 439/399

FOREIGN PATENT DOCUMENTS

| | | |
|---|---|---|
| DE | 43 41 152 C1 | 3/1995 |
| EP | 0 656 672 B1 | 6/1995 |
| EP | 0 720 258 A2 | 7/1996 |

* cited by examiner

*Primary Examiner*—P. Austin Bradley
*Assistant Examiner*—Ross Gushi
(74) *Attorney, Agent, or Firm*—Oliff & Berridge, PLC

(57) ABSTRACT

This connecting device has a conducting core (9) surrounded by an insulating sheath (7), of the type having: an interconnecting part (2) provided with at least one stripping and connecting jaw (4) formed by a tubular body (5) that, in one face, has a stripping and holding slot (6) designed to cut insulating sheath (7), for connecting and holding the conducting core of cable (8), down to conducting core (9), and an insulating housing (3) defining at least one connecting chamber (15) which contains the stripping jaw (4) and which has, in a wall located opposite stripping slot (6), a gripping slot (16) designed to pinch the insulating sheath (7) of cable (8). The gripping slot (16) is at least partially offset laterally from the stripping slot (6).

19 Claims, 1 Drawing Sheet

SELF-STRIPPING CONNECTING DEVICE FOR A SHEATHED ELECTRICAL CONDUCTOR

BACKGROUND OF THE INVENTION

The present invention relates to the technical area of self-stripping connecting devices for connecting sheathed electrical conductors.

It is known that a sheathed electrical conductor can be connected for example with an element belonging to a terminal block with the aid of a self-stripping connection. The device allowing this self-stripping connection has an electrically conducting jaw with a slot whose width substantially corresponds to the diameter of the electrical conductor and whose sharp edges are designed to cut the insulating sheath when the conductor is inserted into the stirrup along the axis of the slot in order to provide electrical contact between the conductor and the stirrup. The stirrup is mounted in an insulating support which itself has a slot aligned with the slot of the stirrup and which ensures passage of the conductor and gripping of the latter. If the jaw holds the conductor, the holding and mechanical strength are improved by the gripping of the insulating sheath in a slot provided in the insulating support.

This configuration confers very good vibration resistance and tensile strength on the conductor along its axis. However, when the conductor is pulled in the direction of the slot, with cables having an insulating sheath of a particular type, the conductor cable may break.

SUMMARY OF THE INVENTION

The goal of the invention is to provide a self-stripping connecting device for a sheathed electrical conductor of the aforementioned type in which the breaking strength of the conductor in the direction of the slot is improved.

For this purpose, the self-stripping connecting device for connecting at least one electrical cable has a conducting core surrounded by an insulating sheath of the type having:

- an interconnecting part provided with at least one stripping and connecting jaw formed by a tubular body that, in one face, has a stripping and holding slot designed to cut the insulating sheath down to the conducting core, for connecting and holding the conducting core,
- and an insulating housing defining at least one connecting chamber which contains the stripping jaw and which has, in a wall located opposite the stripping slot, a gripping slot designed to pinch the insulating sheath of the cable, According to the invention, the connecting device is characterized in that the gripping slot is at least partially offset laterally from the stripping slot.

Depending on the degree of holding force desired, it is possible to implement these various configurations either individually or in various possible combinations.

According to one feature of the invention, the axis of the gripping slot is parallel to the axis of the stripping jaw and offset laterally with respect thereto. Thus, the conductor follows a path from the inside of the stirrup to the outside of the insulating support that is not a straight line but is in the shape of a very open S, which is favorable to holding of the cable and increases the tensile strength of the connection provided by the device according to the invention.

According to another feature of the invention, the gripping slot is inclined and its inclination is such that the area of the gripping slot serving for passage of the conductor, in the connecting position, is offset laterally relative to the area of the stripping slot receiving the conductor in this same connecting position. Once again, the purpose is to confer on the conductor a shape that is non-rectilinear to increase its breaking strength.

According to another feature of the invention, the gripping slot has a local pinch which is preferably but not necessarily located in the vicinity of the end of the slot used for inserting the conductor.

This local pinch in the gripping slot then impedes breakage of the connected cable in the direction of the slot.

Advantageously, the width of the gripping slot in the pinch area is less than its width over the rest of its length.

To improve the breaking strength in the direction of the slot still further, the pinch of the slot provided in the insulating support is offset laterally relative to the axis of the slot in the rest of its length to create a type of baffle.

According to a first option, the local pinch in the slot provided in the insulating support is achieved by forming the insulating support when it is cast.

According to another option, the local pinch in the slot provided in the insulating support is obtained by attaching a part made independently of the support, to the support.

According to the invention, the electrical cable is held in position by the pinching of the conducting core at the slot of the stripping jaw and by pressure applied to the insulating sheath surrounding the cable conducting core at the gripping slot of the insulating housing. These two effects, pinching and gripping, are further accentuated by the at least partially offset configuration of the stripping and gripping slots.

Another goal of the invention is to improve the holding of the connected cable by the gripping slot in the insulating housing.

Thus, according to another feature of the invention, the gripping slot is delimited by two wall elements of the housing, a first element of which, called the supporting element, is thicker than the second element, called the gripping element. Preferably but not strictly necessarily, the supporting element defines the edge of the gripping slot that is located nearest to an axial plane of symmetry of the stripping slot.

According to another preferred feature of the invention, the gripping element is elastically deformable and is less rigid than the supporting element. Thus, the gripping element applies the cable engaged in the gripping slot against the supporting element.

According to another feature of the invention, the gripping element increases in rigidity with distance from the insertion end of the gripping slot. Thus, the gripping element is shaped so that its maximum rigidity is in a region located opposite to the insertion end of the gripping slot and is designed to receive the electrical cable in the connected position.

According to another feature of the invention, the gripping element is integral with a lateral wall in the insulating housing. Preferably but not strictly necessarily, the part of the lateral wall bearing the gripping element has a concave outer face intended to favor elastic deformation of the gripping element and the wall bearing it when the sheathed conductor passes through.

According to a preferred feature, the part of the lateral wall bearing the gripping element is shaped so that it can deform when the cable to be connected is inserted, without increasing the nominal thickness of the insulating housing during this insertion phase.

When several devices according to the invention disposed side by side are used, this advantageous feature of the invention prevents any disorder in juxtaposition when the conductors to be connected are put in place. Since the lateral wall deforms when the conductor passes through, while remaining within the nominal dimensions of the housing, it places no stress on the adjacent housing whose positioning is thus not impeded by the connecting of the electrical cable.

According to another feature of the invention, to prevent the connected cable from being unintentionally extracted, the supporting element, at the insertion end of the gripping slot, has a projecting element defining a local pinch in the gripping slot.

According to another feature of the invention, to facilitate insertion of the cable to be connected, the part of the wall of the housing bearing the gripping element and located opposite the projecting element has a reduced thickness.

Similarly, and according to another feature of the invention, the inner face of the lateral wall of the housing bearing the gripping element has a concave area located opposite a projecting element.

According to another feature of the invention, the gripping element has a reinforcement opposite the projecting element.

According to another feature, the body of the jaw has an essentially C-shaped cross section.

According to a preferred feature of the invention, the body of the jaw has an essentially polygonal cross section having a core from which extend two essentially parallel branches each of which has an arm opposite the core, the ends of which arm define the edges of the stripping slot. Preferably, the arms converge toward each other and opposite the core of the body of the stripping jaw. This feature of the invention increases the effectiveness of the stripping jaw particularly in its electrical cable holding and maintenance function.

DESCRIPTIONS OF THE DRAWINGS

Various other features of the invention will emerge from the description hereinbelow, referring to the attached drawings which illustrate various non-limiting embodiments of the subject of the invention.

DETAILED DESCRIPTION OF EXEMPLARY EMBODIMENTS

Figure 1:
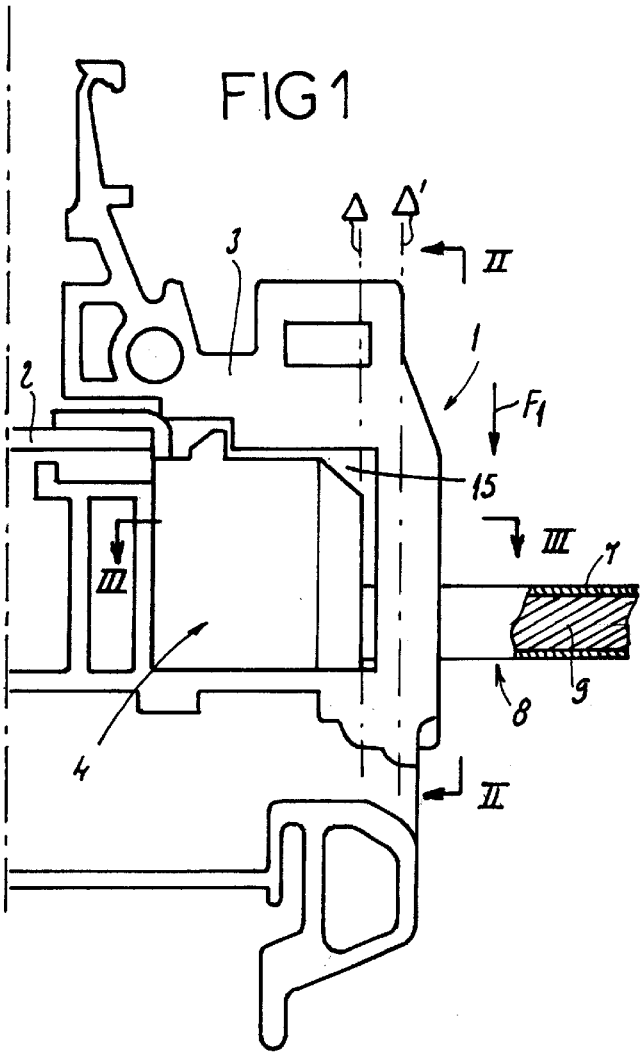
FIG. 1 is a partial view in elevation of a connecting device according to the invention.
Figure 2:
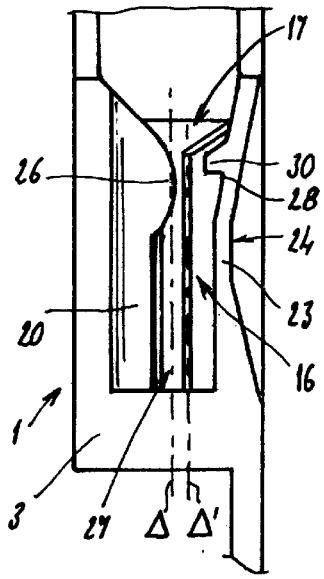
FIG. 2 is a front view of the side on which the conductor is introduced.

As shown in FIGS. 1 and 2, a joining or connecting device according to the invention, designated overall by reference numeral 1, comprises an interconnecting part 2 made of an electrically conducting material disposed in a housing made of insulating material.

Interconnecting part 2 is provided with at least one stripping and connecting jaw 4. According to the example illustrated, the interconnecting part 2 must be considered as having a second stripping jaw, not shown, opposite the stripping jaw 4 illustrated.

Figure 3:
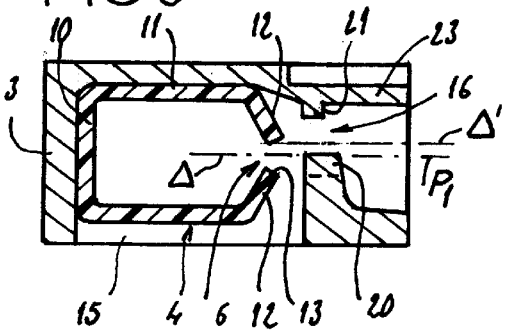
FIG. 3 is a cross section along line III—III in FIG. 1.

As can be seen in FIG. 3, the stripping jaw is formed of a tubular body 5 which in one face has a stripping and holding slot 6 designed to strip the insulating sheath 7 from an electrical cable 8 down to the conducting core 9 of the cable in order to connect and hold this conducting core 9.

Preferably, jaw 4 has a polygonal cross section with a core 10 from which two substantially parallel branches 11 extend. Opposite core 10, each branch 11 has an arm 12 whose free end defines an edge 13 of stripping and holding slot 6. It should be noted that edges 13 are located on either side of an axial plane of symmetry $P_1$ of the body of stripping jaw 4. Preferably but not strictly necessarily, arms 12 converge toward one another, in a direction opposite core 10. This feature of the invention considerably improves the effectiveness of the holding of electrical cable 8 when it is placed in stripping and holding slot 6.

As can be seen from FIGS. 1 and 3, insulating housing 3 defines a connection chamber 15 which contains stripping jaw 4. Stripping chamber 15 has, in a wall located opposite stripping slot 6, a gripping slot 16 intended for passage of electrical cable 8 when it is connected to jaw 4.

It should be noted that insulating housing 3, at one insertion end 17 of gripping slot 16, has an opening for placing cable 8 in line with stripping slot 6 and gripping slot 16 before its engagement in stripping slot 6 and gripping slot 16 by a translational movement parallel to axis Δ of the stripping slot in the direction of arrow F1.

According to the preferred embodiment illustrated in FIGS. 1 to 3, axis Δ' of gripping slot 16 is parallel to axis Δ of the stripping slot and is offset laterally therefrom in a front view of the housing, as seen in particular in FIG. 2. This particular arrangement of stripping slot 6 and gripping slot 16 gives the connected electrical cable an S-shape conductive to proper holding of the electrical cable.

In addition, in the preferred embodiment illustrated, the gripping slot is delimited by two wall elements 20, 21 of housing 3, each of which defines one edge of the gripping slot. Each of the two elements 20, 21 has a different function and a different behavior to provide the best possible holding of the sheathed electrical cable engaged in gripping slot 16.

Thus, gripping slot 16 is delimited by a first wall element 20 known as a "supporting" wall element, opposite which is disposed a second wall element 21 known as the "gripping" wall element.

According to the example illustrated and preferred, supporting element 20 defines the edge of gripping slot 16 closest to an axial plane of symmetry $P_1$ of stripping jaw 4. According to the example illustrated, supporting element 20 is thicker than gripping element 21. This difference in thickness is then preferably associated with a difference in the behavior of supporting element 20 and of gripping element 21 when the electrical cable to be connected is put in place. This is because gripping element 21 is shaped such that it deforms elastically when the electrical cable 8 to be connected is inserted, while supporting element 20 is shaped to offer a substantially rigid support for the electrical cable 8 which is then urged against supporting element 20 by gripping element 21.

To ensure proper holding of electrical cable 8 in the connecting position while not impeding its insertion into the gripping slot, gripping element 21 is preferably formed so that its rigidity increases with increasing distance from insertion end 17. The rigidity is then preferably at a maximum in the area of gripping slot 16 located opposite the insertion end 17.

According to the example illustrated, gripping element 21 is formed by a rib integral with a lateral wall 23 in insulating housing 3.

To render gripping element 21 deformable, lateral wall 23 has a concave area 24 at its outer face. The center of concave area 24 is preferably in the vicinity of the insertion end 17 to provide gripping element 21 with increasing rigidity. This is because concave part 24 gives lateral wall 23 a thickness that increases with distance from insertion end 17.

According to one advantageous feature of the invention, the concave area 24 of lateral wall 23 is dimensioned such that, when a cable is inserted into gripping slot 17, gripping element 21 and lateral wall 23 deform without increasing the nominal thickness of insulating housing 3.

Thus when a cable is placed in the terminal block according to the invention, as the cable progresses in stripping slot 6 and gripping slot 16, supporting element 20 remains immobile while the gripping element first retracts and then pushes the cable sheath against the supporting element. This pressure exerted by the gripping element causes the sheath to deform and it flows on either side of the supporting element to form a constriction that confers positive immobilization and good tensile strength on the connection brought about in the device according to the invention.

To prevent unintended release of the cable from shipping slot 6 and gripping slot 16, the stripping slot has a local pinch preferably but not exclusively in the vicinity of its insertion end.

According to the example illustrated, pinch is defined by a projecting element 26 forming an integral part of supporting element 20 and located at insertion end 17. Thus, projecting element 26 defines the local pinch at which gripping slot 16 is narrower than its width in a region 27 located opposite insertion end 17 and in which cable 8 is situated in the connection position.

According to the example illustrated, to enable the electrical cable to be easily inserted into the gripping slot despite the presence of projecting element 26, wall 23 bearing gripping element 21 is thinner in its area opposite element 26. For this purpose, the inside face of wall 23 has a concave area 28 located opposite projecting element 26.

In addition, gripping element 21 preferably but not strictly necessarily has a reinforcing element 30 located opposite projecting element 26. The purpose of this reinforcing element 30, in conjunction with projecting element 26, is to prevent unintended release of projecting element 26 from gripping slot 16.

It should also be noted that projecting element 26 and reinforcing element 30 as well as supporting element 20 and gripping element 21 are all shaped so as not to impede insertion of the electrical cable into the housing and into the housing and into the stripping slot while ensuring that the cable is held once it is fully connected in the manner of a non-return system. To accentuate this non-return effect, the local pinch is offset laterally relative to axis Δ' of gripping slot 16 so that the latter has a baffle shape as shown in FIG. 2.

Thus, the connecting device according to the invention makes it very unlikely that the connected cable will become disconnected by vibration or pulling in a direction traverse or parallel to stripping slot 6 and gripping slot 16.

According to the example illustrated above, the offset of the gripping slot holding area, in which the electrical cable is located in the connected position, is ensured by complete lateral offset of the axis of gripping slot 16 relative to the axis of stripping slot 6. However, according to the invention, this offset of holding area 26 can be provided in any other way.

Figure 4:
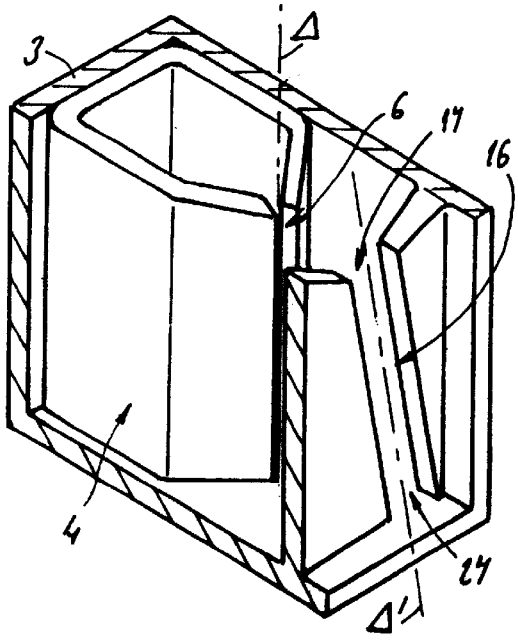
FIG. 4 is a view showing another embodiment of a device according to the invention.

Thus, FIG. 4 illustrates another embodiment of the invention according to which the axis Δ' of gripping slot 16 is inclined relative to axis A of stripping and holding slot 6.

Thus, with this shape, part 27 of gripping slot 16 in which the electrical cable is held in the connected position is offset laterally relative to stripping slot 6.

Of course, the invention is not confined to the embodiments described above as examples but on the contrary includes all variants. Thus, in particular, the various features described above could be implemented individually or in different combinations without thereby departing from the framework of the invention.

What is claimed is:

1. A self-stripping connecting device for connecting at least one electrical cable having a conducting core surrounded by an insulating sheath, comprising:

an interconnecting part provided with at least one stripping jaw formed by a tubular body having a stripping slot to cut the insulating sheath to the conducting core, for connecting and holding the conducting core of the electrical cable, the stripping slot comprising stripping edges on either side of an axial place that laterally bisects the stripping jaw along the stripping slot; and an insulating housing defining at least one connecting chamber which contains the stripping jaw and, in a wall located opposite stripping slot, a gripping slot having gripping edges to pinch the insulating sheath of the electrical cable, wherein the gripping edges are offset laterally from the axial plane for at least part of the gripping slot, wherein the gripping slot is delimited by two wall elements of the insulating housing, including a supporting element and a gripping element, wherein the supporting element is thicker than the gripping element, wherein the gripping element is elastically deformable and is less rigid than the supporting element, and wherein the gripping element increases in rigidity with a distance from an insertion end of the gripping slot.

2. The connecting device according to claim 1, wherein the gripping edges are parallel to a first axis, the stripping edges are parallel to a second axis, the first axis of the gripping slot is inclined relative to the second axis of the stripping slot so that a region of the gripping slot receiving the cable in a connected position is offset in the direction perpendicular to the axial plane.

3. The connecting device according to claim 1, wherein the gripping edges are parallel to a first axis along the gripping slot, the stripping edges are parallel to a second axis along the stripping slot, the first axis of the gripping slot is parallel to the second axis of the stripping slot.

4. The connecting device according to claim 1, wherein the supporting element defines a gripping edge of the gripping slot located nearest to the axial plane.

5. The connecting device according to claim 1, wherein the gripping element is shaped to have a maximum rigidity in a region located opposite to the insertion end of the gripping slot and to receive the electrical cable in a connected position.

6. The connecting device according to claim 1, wherein the body of the stripping jaw has an essentially C-shaped cross section.

7. The connecting device according to claim 1, wherein the body of the stripping jaw has an essentially polygonal cross section having a core from which extends two substantially parallel branches each branch having an arm opposite to the core, each arm having an end that defines one edge of the stripping slot.

8. The connecting device according to claim 7, wherein the two arms converge toward each other opposite the core of the body of the stripping jaw.

9. The connecting device according to claim 1, wherein the gripping slot has a local pinch.

10. The connecting device according to claim 9, wherein the local pinch in the gripping slot is obtained by shaping the insulating housing when the insulating housing is molded.

11. The connecting device according to claim 9, wherein the local pinch of the gripping slot is located in a vicinity of an insertion end of the gripping slot.

12. The connecting device according to claim 11, wherein the local pinch of the gripping slot is offset laterally relative to a first axis along the gripping slot.

13. The connecting device according to claim 1, wherein the supporting element, at an insertion end of the gripping slot, has a projecting element defining a local pinch in the gripping slot.

14. The connecting device according to claim 13, wherein the gripping element has a reinforcement opposite to the projecting element.

15. The connecting device according to claim 1, wherein the gripping element is integral with a lateral wall in the insulating housing.

16. The connecting device according to claim 15, wherein a part of the lateral wall bearing the gripping element has a concave outer face.

17. The connecting device according to claim 16, wherein an inner face of the lateral wall of the insulating housing bearing the gripping element has a concave area located opposite to the projecting element.

18. The connecting device according to claim 15, wherein a part of the lateral wall bearing the gripping element is shaped so that the lateral wall can deform when the cable to be connected is inserted, without increasing the nominal thickness of the insulating housing during the insertion.

19. The connecting device according to claim 18, wherein the part of the lateral wall bearing the gripping element and located opposite to a projecting element has a smaller thickness than other portions of the insulating housing.

* * * * *